United States Patent [19]

Posner et al.

[11] Patent Number: 4,986,997

[45] Date of Patent: Jan. 22, 1991

[54] METHOD OF SEPARATING WHEAT GERM FROM WHOLE WHEAT

[75] Inventors: Elieser S. Posner, Manhattan, Kans.; Yuzhou Li, Zengzhou, China

[73] Assignee: Kansas State University Research Foundation, Manhattan, Kans.

[21] Appl. No.: 340,495

[22] Filed: Apr. 19, 1989

[51] Int. Cl.[5] ..... B02C 4/00; B02C 9/00

[52] U.S. Cl. ..... 426/622; 241/6; 241/8; 241/9; 241/11; 426/478; 426/481; 426/484

[58] Field of Search ..... 241/6, 7, 8, 9, 11; 426/478, 481, 482, 483, 622, 627, 484

[56] References Cited

U.S. PATENT DOCUMENTS

| | | | |
|---|---|---|---|
| 1,849,786 | 3/1932 | Bloede et al. | 241/7 |
| 2,190,095 | 2/1940 | Brown | 241/8 |
| 2,392,365 | 1/1946 | Carter | 241/7 |
| 2,459,548 | 1/1949 | Singer et al. | 241/8 |
| 2,464,212 | 3/1949 | Carter et al. | 241/7 |
| 2,509,418 | 5/1950 | Brown | 241/8 |
| 3,222,183 | 12/1965 | Rozsa et al. | 426/482 |
| 3,979,375 | 9/1976 | Rao et al. | 241/8 |
| 4,126,707 | 11/1978 | Hart | 241/9 |
| 4,133,899 | 1/1979 | Wolffing et al. | 241/11 |
| 4,189,503 | 2/1980 | Giguere | 426/483 |
| 4,301,183 | 11/1981 | Giguere | 426/482 |
| 4,329,371 | 5/1982 | Hart | 241/7 |

OTHER PUBLICATIONS

Association of Operative Millers-Bulletin, dated Apr. 1988, "Reduction of Tempering Time by Fissuring and Its Effect on Milling[1]"; author: Meda P. Shyam and E. S. Posner[2].

Association of Operative Millers-Bulletin, dated Oct. 1985, "The Technology of Wheat Germ Separation in Flour Mills[1,2]"; author: E. S. Posner.

OCRIM brochure, "Intensive Horizontal Scourer SIG".

OCRIM brochure, "Spazzola Grano Intensiva/Horizontal Scourer SIG".

CFW Research article, #886/Dec. 1987, vol. 32, No. 12, "Wheat Temper Time Reduced by Fissuring[1]"; author: E. S. Posner[2].

GOLFETTO brochure, "Vertical Grain Scourer Mod. G.S.P.s.V."; brochure No. A12.

GOLFETTO brochure, "Vertical Maize Degerminator Model GDMV", brochure No. A24.

*Primary Examiner*—Marianne Cintins
*Assistant Examiner*—D. Workman
*Attorney, Agent, or Firm*—Hovey, Williams, Timmons & Collins

[57] ABSTRACT

A stepwise process for the treatment of wheat as an adjunct to conventional milling is provided which permits recovery of substantial quantities of wheat embryo and scutellum, to thereby increase the yield of premium germ while enhancing the storability of the resultant flour by virtue of removal of the high oil germ fractions. The process involves initial tempering of wheat followed by impact scouring to remove intact embryo; thereupon, the deembryonated wheat is subjected to a second tempering step prior to milling. The break system of the mill is appropriately modified by judicious selection of milling gap so as to permit recovery of intact scutellum, especially from hard red winter wheat.

8 Claims, 1 Drawing Sheet

METHOD OF SEPARATING WHEAT GERM FROM WHOLE WHEAT

BACKGROUND OF THE INVENTION

1. Field of the Invention

The present invention is concerned with processes for separately removing the embryo and scutellum fractions from whole wheat as an adjunct to the milling process, so as to give substantial increases in wheat germ production, while at the same time yielding finished flour having only minimal, high oil content germ fractions therein, so that the flour exhibits enhanced storability. More particularly, it is concerned with such processes (and the resultant products) wherein tempering and mechanical treatment of the starting wheat are carefully controlled in order to maximize embryo and scutellum separation, making use of conventional equipment typically found in flour mills.

2. Description of the Prior Art

The wheat germ fraction of whole wheat is a unique source of highly concentrated nutrients. It offers much higher protein of high biological value, fat, sugar and mineral content when compared to flour derived from endosperm. Wheat germ is the richest source known of tocopherols (Vitamin E) of plant origin and is also a rich source of thiamine, riboflavin, and niacin. The presence of a large amount of fat and sugar makes wheat germ highly palatable.

Being highly nutritive and palatable, wheat germ is an excellent source of protein and vitamins for fortification of food products. The oil obtained from germ has been a good source of material for production of vitamins in medication and cosmetic industry. Wheat germ therefore commands a premium price in the marketplace.

However, if wheat germ is left in flour, it can adversely affect flour and particularly the storage quality thereof. The highly unsaturated germ oil and rich oxidative and hydrolytic enzymes can initiate and accelerate reactions resulting in increase of acidity and oxidative rancidity. Accordingly, the efficient separation of wheat germ from whole wheat represents a significant commercial factor.

The product referred to as "wheat germ" in the milling industry is actually the embryo constituent of the wheat germ organ, whereas in reality (and as used in botanical science) wheat germ is defined as both the embryo and scutellum fractions of the wheat kernel. This difference in semantics largely stems from the fact that millers have been unable to efficiently remove scutellum from wheat, this fraction normally being carried over with the bran. Economically, wheat scutellum would be even more valuable than the embryo fraction, because scutellum is higher in vitamin and total fat content than embryo. In any event, current technology of germ separation gives yields of about 0.4–0.5 percent by weight of embryonic germ.

An extensive review of current techniques of germ separation is found in "The Technology of Wheat Germ Separation in Flour Mills", *Association of Operative Millers—Bulletin,* published in October, 1985. One conventional method is to separate embryonic germ in the break system, in the form of intact germ, by specially designed "germ separator." This requires a large investment in sophisticated equipment and high operational costs. In another method, middlings containing germ particles are passed through a pair of smooth rolls where germ is flatened and separated by sifting. A major disadvantage of this method is that germ oil can be expressed out of the germ particles and transferred to the final flour, which causes loss of valuable germ oil and contamination of the flour.

Accordingly, there is a real and unsatisfied need in the art for a method of efficient embryo separation so as to increase germ yields and minimize flour contamination. In like manner, a method of scutellum separation would represent a significant advance in the art, inasmuch as this would further enhance germ yields and/or give a new, commercially attractive byproduct for the miller. Obviously, if these two goals could be achieved in a simple, stepwise operation as an adjunct to conventional milling processes and without the requirement of sophisticated equipment, the economic benefit to the milling industry would be considerable.

SUMMARY OF THE INVENTION

The present invention overcomes the problems noted above and provides processees which can efficiently remove both the embryo and scutellum fractions from whole wheat as a part of the milling process, through careful control of tempering and mechanical handling of whole wheat kernels.

In one aspect of the invention, a stepwise method is provided for separating both the embryo and scutellum fractions from wheat. This method involves initially tempering the wheat to a total moisture content permitting maximum impact detachment of embryo, most preferably about 13.5 percent by weight moisture. Thereafter, the tempered wheat is subjected to mechanical impact forces sufficient to free the embryo from the wheat; most preferably, use is made of a horizontal scouring device comprising an elongated rotor with radially outwardly extending impacting beaters housed within a tubular-perforated metal screen. Such a scouring device has been shown to give excellent embryo separation. This separates the bulk of the embryo, which can then be purified by appropriate sifting techniques.

The deembryonated wheat is then subjected to a second tempering step, in order to increase the moisture content thereof (most preferably to about 16 percent by weight) for scutellum separation. The latter occurs during the break process of milling, wherein the deembryonated wheat is subjected to treatment by successive pairs of break rolls. In practice, scutellum is removed after the third break, wherein the third break fine rolls are separated by a controlled clearance gap of about 0.010–0.012 inches, most preferably about 0.011 inches. The relevant upstream break roll clearances (first break and second break) are about 0.025 inches and about 0.018 inches, respectively.

The embryo and scutellum are thus separately removed from the wheat, while the endosperm fraction thereof is processed into a high quality final flour having only a minimum of germ-related contaminants therein.

Those skilled in the art will also appreciate that, if desired, a miller may elect to remove embryo from the wheat using the methods of the invention, while leaving the scutellum fraction; similarly, deembryonated wheat obtained by any known means can be subjected to the scutellum separation method of the invention to good effect.

DESCRIPTION OF THE PREFERRED EMBODIMENTS

Figures 1, 2:
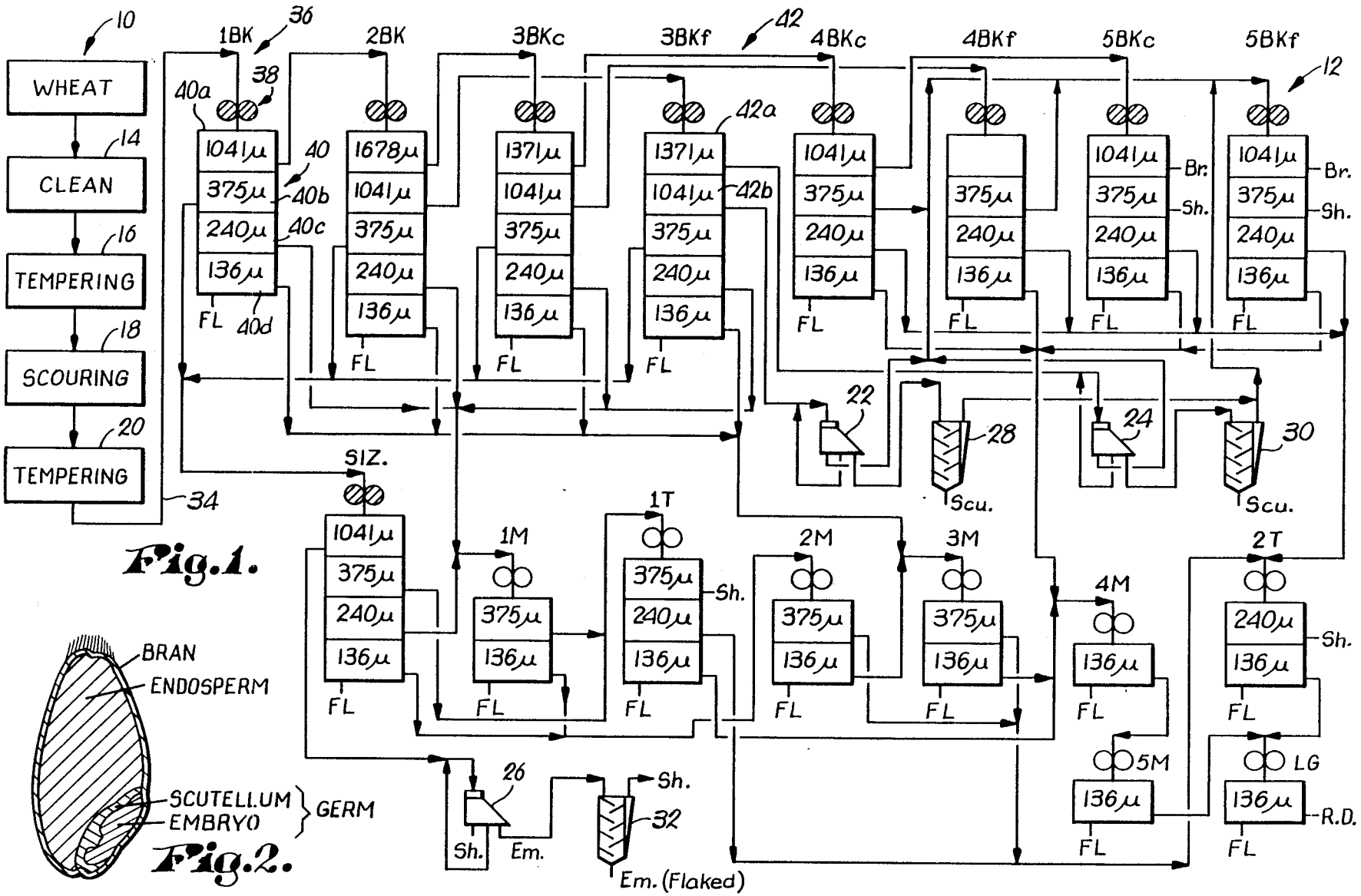
FIG. 1 is a schematic representation of the preferred steps and milling apparatus used for the processing of hard red winter wheat and hard red spring wheat.
FIG. 2 is a cross-sectional view of a wheat kernel, illustrating important constituent parts thereof.

FIG. 2 schematically illustrates in cross-section the important portions of the wheat kernel. As illustrated, the kernel is primarily endosperm (about 82.5 percent), with bran (about 15 percent) and germ (about 2.5 percent) constituting the balance. During the milling process, an attempt is made to separate these parts of the wheat kernel, for all of the described reasons.

As can be seen in FIG. 2, the germ is composed of two parts, the embryo and the scutellum, the latter functioning as a storage, digestive, and absorbing organ. During germination, the scutellum not only supplies food, but also becomes an organ for the transfer of food from the endosperm to the growing parts of the embryonic axis. Inasmuch as the germ is a separate and distinct part of the seed, there are natural lines of cleavage between the germ and endosperm and germ and bran. From this it would be seen that the germ should be easily separated, even from the dry kernel.

Experience has proved, however, that while a relatively small proportion of wheat embryo can be cleaved from the kernel during the milling process, it has been impossible to efficiently separate scutellum from bran. It is believed that the epithelial layer separating the scutellum from remaining portions of the wheat kernel is sufficiently strong to resist cleavage under normal milling conditions.

As indicated above, the most preferred process of the invention involves the stepwise removal of embryo from wheat followed by scutellum removal during and as a part of the milling process. In order to facilitate an understanding of the invention, it is helpful to separately consider the steps of embryo removal and scutellum separation/milling.

Embryo Removal

In order to remove the embryo from cleaned wheat, the wheat is first tempered to a moisture content of from about 13–14 percent by weight, most preferably about 13.5 percent by weight. This is accomplished in the conventional manner, by adding sufficient water to the wheat to increase the moisture content to the desired level. The amount of water is calculated, based upon the native water content of the flour. The water is initially added with stirring, whereupon the wheat/water mixture is allowed to stand for a period of time to achieve tempering, typically 6–15 hours.

Impact removal of the embryo from the tempered wheat is advantageously accomplished in a horizontal scouring device. Such units are conventional, and include an elongated rotor equipped with canted radially outwardly extending beaters along the length thereof. The rotor is housed within a perforated metal screen. In use, the tempered wheat is directed into one end of the scouring chamber, while the rotor is rotated at a desired speed to effect embryo detachment. Wheat and crude embryo are thereby collected separately.

It has been found that the speed of the impactor tips is an important factor because it has a square-law effect on the kinetic energy of the impactor, the source of energy directed against the wheat kernels. The peripheral speed of the impactors should not be increased unduly, else unwanted breakage of the wheat kernels (other than along the cleavage between embryo and scutellum) may occur. Similarly, low tip speed will adversely effect embryo detachment.

In the development of the present invention, use was made of a laboratory sized Forester horizontal scouring device. This machine was driven by a variable speed motor, and was equipped with a screen having openings of two millimeters in diameter. With this unit, a tip speed of 21.2 meters per second was found to be optimum, although speeds from 18–25 meters per second could be employed. It is believed that the optimum 21.2 meters per second tip speed should be the technical guideline for the selection of impactor tip peripheral speed in a commercial scouring device; that is to say, for such a commercial unit tip speed should be suitably adjusted based upon this standard.

With appropriate impactor tip peripheral speed, the embryo yield varies with the total number (frequency) of impactor-wheat kernel collisions during scouring. This frequency is determined by factors including feeding rate, diameter of impactors, width of impactors, number of impactors, and angle of inclination of impactors. The frequency of collision is positively proportional to the impactor working volume (W), defined as the space volume that the impactor working section passes per unit time. For a certain feeding rate (Q), the larger the W value, the more times total collisions will occur. To achieve good embryo yield, the W/Q ratio must be larger than a certain value. For a scourer with Q capacity, $$W/Q = \pi(pi) \times (R^2 - r^2) L\omega / 60\, Q$$

where $\omega$ is the impactor shaft revolutions per minute; R and r are the dimensions of the working sections of the impactors; and L and n are the width and number of the impactors, respectively.

Based upon experimental results, it has been found that the ratio W/Q is optimized at a value of 5.95 (pi) $m^3$/kg. This value is suggested as a basic criterion for the selection and modification of a scourer for embryo separation. Significant deviation of W/Q from the noted value may result in a decrease of embryo yield. Although the suggested W/Q value can be realized by changing several equipment factors, the simplest modification is to increase the number of impactors installed.

The collected crude embryo fraction from the scouring device may be appropriately purified by sifting. In the case of hard red winter wheat and soft winter wheat, a pair of superposed sieves (1,000 micron, 656 micron) can be employed. The overs from the 1,000 micron screen are sent to milling, whereas the overs from the 656 micron screen are conveyed to an air separator for removal of fines and collection of purified embryo. In the case of durum wheat, the sifting apparatus includes a 2380 micron, 1410 micron and 656 micron sieve: the overs from the first two sieves are sent to milling, whereas the overs from the 656 sieve are subjected to fines removal and embryo collection.

Any remaining embryo carried to the milling process is removed therein in a manner to be described.

The deembryonating process of the invention yields embryo in the range of 54 to 91.6 percent of total wheat embryo (0.74 percent to 1.20 percent of wheat weight)

among different wheat varieties and classes, with soft white winter wheat giving the lowest yield. This is significantly in excess of conventional commercial germ (embryo) yields of about 0.4 to 0.5 percent by weight.

Scutellum Separation

One goal of the present invention is to provide a method for scutellum separation and recovery without the need for costly equipment or significant rearrangement of the traditional milling process. Furthermore, it is important to maintain the integrity of the scutellum during processing in order to enhance the storability of the final flour and the nutritional qualities of the separated scutellum.

Broadly speaking, the system of the invention involves subjecting deembryonated wheat to a secondary tempering step in order to elevate the moisture content of the wheat to a level of about 15–17 percent by weight, most preferably about 16 percent by weight in the case of hard red winter wheat, 15.5 percent in the case of soft white winter wheat, and 17.0 percent in the case of durum wheat (achieved by tempering to 16.5 percent moisture for 2–2.5 hours, followed by tempering to 17.0 percent moisture for 0.5 hours.

After the secondary tempering step, the wheat is subjected to a milling technique involving, inter alia, passage of wheat through a series of pairs of break rolls. At an appropriate point in this process, preferably at the third break, scutellum is collected. In order to avoid pulverization, the milling gap of the third break fine rolls is important. In one system studied, the clearance of 0.010–0.012 inches was found acceptable, with the most preferred clearance being 0.011 inches. As can be appreciated, too small a milling gap will lead to broken scutellum, whereas with a wider gap, endosperm on bran particles will not be sufficiently removed to generate the required difference in specific gravity and surface characteristics between the bran and scutellum permitting downstream separation.

Attention is next directed to FIG. 1 which illustrates the overall process of the present invention, in the context of hard red winter wheat and hard red spring wheat. The process broadly includes the preliminary deembryonation/tempering procedure 10, together with milling system 12.

The procedure 10 involves cleaning 14 of incoming wheat by conventional means to remove foreign unmillable materials, followed by initial tempering as at 16. The initially tempered wheat is then scoured as at 18, followed by secondary tempering 20. All of these steps are as described in detail above.

In the depiction of system 12, the following abbreviations apply: "BK" refers to a break system comprised of a pair of break rollers and an associated set of sieves: "BKc" refers to a coarse break system; "BKf" refers to a fine break system; "FL" refers to collected flour; "Br" refers to collected bran; "Sh" refers to collected shorts from the process; "Scu" refers to collected scutellum; "SIZ" refers to a sizing system having a pair of sizing rolls and associated sieve system; "M" refers to a middlings system having a pair of rolls and a sieve system: "T" refers to a tailings system having a pair of rollers and a sieve system; "LG" refers to a low-grade system having a pair of rolls and a sieve: "Em" refers to collected embryo; and "R.D." refers to the so-called "red dog" fraction.

Furthermore, the devices 22, 24 and 26 illustrated in system 12 are conventional gravity tables while the devices 28, 30 and 32 are known air separators.

In the system 12 shown, the break roller systems 1BK–5BKf are configured for D—D (dull—dull) action and have the following additional specifications:

| | CORRUGATIONS/in. FAST/SLOW | SPEED DIFFERENTIAL |
|---|---|---|
| 1BK | 11/11 | 2.5:1 |
| 2BK | 20/20 | 2.5:1 |
| 3BKc | 16/16 | 2.5:1 |
| 3BKf | 20/22 | 2.5:1 |
| 4BKc | 20/22 | 2.5:1 |
| 4BKf | 20/22 | 2.5:1 |
| 5BKc,f | 20/22 | 2.5:1 |

The foregoing information, together with a study of FIG. 1, will of course fully apprise those skilled in the art of all details of the preferred system of the invention. As is the convention with such schematic depictions, the flow of product is illustrated by the directional arrows. Thus, for example, deembryonated wheat from the secondary tempering stage 20 is passed by appropriate conveying means 34 to the first break apparatus 36 wherein the wheat passes between the first break rolls 38. Thereafter, the first break grounded material is treated in the sieve array 40, comprising respective sieves **40*a*–40*d* having openings of 1041, 375, 240 and 136 microns. The overs collected in the first sieve 40*a* are as shown transferred to the second break system 2BK; the overs collected in second sieve 40*b* are transferred to the sizing system SIZ; the overs from third sieve 40*c* are conveyed ultimately to the first middling treatment system 1M; the overs collected in fourth sieve 40*d* are passed to the third middling treatment system 3M; and the throughs from fourth sieve 40*d*** are collected as flour FL.

Similar considerations apply with respect to the remaining stages of milling system 12, insofar as the basic flow through the system is concerned.

However, it will be seen that fractions collected from the third break apparatus 3BKf 42 are recovered as the scutellum fraction. Specifically, the overs from first sieve **42*a* (1371 microns) are passed to gravity table 24 and thence to air separator 30 for scutellum collection. Similarly, the overs from second sieve 42*b* (1041 micons) are conveyed to gravity table 22 where a portion thereof passes through air separator 28 for scutellum collection. The fines from separator 28, 30** are ultimately passed to the fifth break system 5BKf as shown.

A certain proportion of the embryo would typically be carried over into milling system 12 from the process 10. In order to collect this valuable carryover, the material collected as overs in the first sieve (1041 microns) of sizing system SIZ is conveyed to gravity table 26, and thereupon to air separator 32 for collection of flaked embryo.

A laboratory-sized system as depicted in FIG. 1 was prepared using a combination of Witt and Ross roll stands for batch-type milling. The break rolls were configured as set forth above, whereas the remaining roll systems were in accordance with conventional practices. Sifting was carried out with a Great Western laboratory sifter. Each sieve had a 12×12 inch surface area, and the sifter rotated at 160 rpm (4-inch throw). Sifting time for each system varied according to the characteristics of the stock to be treated. To facilitate the sieving out of flour, three cotton belt brushes were used in the cleaning frame beneath the 136 micron flour sieves. A gravity separator was used for the separation of the scutellum and embryo flakes from the mill stream. It was a positive-pressure operated machine with vibratory movement and a table of perforated fabric that allowed the materials to float and advance on the level of the fabric.

In the use of such a laboratory system, 5000 g. of hard red winter wheat having an initial moisture of 12.54 percent by weight was processed. The wheat was cleaned by screening which removed 125 g. (2.5 percent) of extraneous materials. The cleaned wheat was then initially tempered for 10 hours to 13.5–14.0 percent moisture and scoured as described above using the laboratory scouring device. This resulted in collection of 59 g. of purified embryo (1.2 percent) and removal of 49 g. (1 percent) of shorts. The deembryonated wheat was then subjected to a second tempering to elevate the moisture content to 16 percent by weight. A 12 hour tempering time was employed.

The tempered wheat was then passed through the laboratory milling system set-up in accordance with FIG. 1 and the foregoing information. This resulted in mill stream collections as follows:

| | | |
|---|---|---|
| Wheat | 4966 g. | (100%) |
| Break flour | 477 g. | (9.6%) |
| Reduction flour | 3039 g. | (61.2%) |
| Scutellum | 36 g. | (6.79%) |
| Flaked embryo | 10 g. | (0.20%) |
| Bran | 392 g. | (7.9%) |
| Shorts | 804 g. | (16.2%) |
| Red dog | 83 g. | (1.63%) |
| Loss | 124 g. | (2.5%) |

It will thus be appreciated that the total yield of embryo from the process was 1.4 percent, which is greatly in excess of conventional techniques. Similar treatment of soft white winter wheat typically gives embryo yields of 1.1 percent on wheat weight. Moreover, the large quantity of intact embryo separated in accordance with the invention retains its fat content and is significantly higher (2–3 percent) than that of the embryo flakes.

Scutellum recovery is likewise significant, and gives promise of a new, commercially significant by-product for the miller. While scutellum separation from hard red winter wheat is demonstrably achievable, the mechanical durability of soft white winter wheat scutellum, and the special grinding requirements of durum wheat, the separation of scutellum from these two wheats is very difficult.

Those skilled in the art will readily perceive that the concepts of the present invention may be utilized in a wide variety of presently existing mills, and that alterations of the mills to accommodate the invention may be readily undertaken.

We claim:

1. A method of separating both the embryo and scutellum fractions from wheat to thereby increase the yield of wheat germ from the wheat and to produce wheat flour from the resultant wheat, said method comprising the steps of:

initially tempering said wheat to an initial total moisture content adapted to permit maximum impact detachment of embryo from the wheat;

detaching embryo from said initially tempered wheat by subjecting the wheat to a mechanical impact sufficient to free a substantial part of said embryo from the wheat while leaving most of the scutellum fraction attached thereto;

separating at least a portion of said detached embryo from the deembryonated wheat, and collecting said separated embryo;

subjecting the deembryonated wheat to a second tempering step to increase the moisture content thereof to a second moisture content that is higher than the initial moisture content and that is adapted to permit maximum detachment of scutellum from the deembryonated wheat; and separating a substantial part of the scutellum fraction from the deembryonated wheat, including the steps of passing the deembryonated wheat through at least one pair of break rolls, collecting said separated scutellum, and processing the wheat into wheat flour.

2. The method of claim 1, said initial total moisture content being from about 13 to 14 percent by weight.

3. The method of claim 2, said initial total moisture content being about 13.5 percent by weight.

4. The method of claim 1, said second moisture content being from about 15 to 17 percent by weight.

5. The method of claim 4, said second moisture content being about 16 percent by weight.

6. The method of claim 1, said detaching step comprising the steps of passing said initially tempered wheat through a scouring apparatus equipped with shiftable impacting elements, and causing said elements to contact said wheat to effect embryo detachment.

7. The method of claim 1, including the steps of separately recovering said detached embryo and separated scutellum.

8. The method of claim 1, said one pair of break rolls having a clearance therebetween of about 0.010 to 0.012 inches.

* * * * *